US005393045A

United States Patent [19]

Fujimoto

[11] Patent Number: 5,393,045

[45] Date of Patent: Feb. 28, 1995

[54] SHEET MEDIUM DISPENSING APPARATUS HAVING A RECESS TO PERMIT BUCKLING OF A LOWERMOST SHEET

[75] Inventor: Tadashi Fujimoto, Tokyo, Japan

[73] Assignee: Juki Corporation, Tokyo, Japan

[21] Appl. No.: 130,000

[22] Filed: Sep. 30, 1993

[30] Foreign Application Priority Data

Oct. 2, 1992 [JP] Japan ..... 4-068932[U]

[51] Int. Cl.[6] ..... B65H 3/30

[52] U.S. Cl. ..... 271/23; 271/111

[58] Field of Search ..... 271/110, 111, 119, 161, 271/165, 23, 19

[56] References Cited

U.S. PATENT DOCUMENTS

| | | | |
|---|---|---|---|
| 3,937,455 | 2/1976 | Hauser | 271/119 X |
| 4,653,742 | 3/1987 | Sasaki et al. | 271/119 X |
| 4,715,593 | 12/1987 | Godlewski | 271/165 X |

FOREIGN PATENT DOCUMENTS

| | | | |
|---|---|---|---|
| 1205113 | 11/1965 | Germany | 271/119 |
| 156143 | 4/1980 | Japan . | |
| 031755 | 5/1980 | Japan . | |
| 61539 | 5/1980 | Japan | 271/23 |
| 156144 | 12/1980 | Japan | 271/110 |
| 17834 | 2/1981 | Japan . | |
| 145044 | 11/1981 | Japan . | |
| 59137 | 4/1983 | Japan | 271/110 |
| 8802734 | 4/1988 | WIPO . | |

*Primary Examiner*—Robert P. Olszewski
*Assistant Examiner*—Boris Milef

[57] ABSTRACT

An apparatus for dispensing, one by one, a stack of media as stacked in a stacker table by friction rollers to separate and supply the media to the next work station. The friction rollers are rotated in such a manner that rotational force thereof is provided to overcome any frictional resistance generated between the media so that no slip is caused between the rollers to obtain a smooth medium without damage thereto.

2 Claims, 3 Drawing Sheets

SHEET MEDIUM DISPENSING APPARATUS HAVING A RECESS TO PERMIT BUCKLING OF A LOWERMOST SHEET

BACKGROUND OF THE INVENTION

1. Field of the Invention

This invention relates to a sheet or web-like medium dispensing apparatus, and more particularly, to a dispenser which is designed to dispense, one by one, a stack of media, in the form of a lamina or web, such as reproduction paper or the like in a suitable size and then separate the medium from the media, feed them to the next work station.

2. Prior Art

A dispenser for separating and feeding, one by one, a stack of sheet or web-like media such as reproduction paper, printing paper, and a blank sheet of paper, lamina or web has been widely used in various types of industrial equipments and apparatus such as an enveloping and sealing machine, a reproducing machine, a facsimile transmitter and receiver unit, a printing press, a converter machine for paper or the like, and an office automation instrument and the like.

A dispensing apparatus of this class as aforementioned comprises, as shown in the accompanying drawings, FIG. 3, a stacker table 1 so disposed as to incline its forward end downwardly, a stopper 2 against which a stack of media 3 on the stacker table, a pair of friction rollers 7, 8 of rubber or the like, and openings 5, 6 formed in the table 1 to have a portion of each of the friction rollers extended and passed therefrom and therethrough whereby only lowermost medium 4 is dispensed and fed to the next work station by timing and operating the rollers to provide frictional rotation thereof.

The foregoing apparatus is defective in that media are stacked to each other without any clearance therebetween and are thus subject to resistance against surface friction thereof, resulting in considerable resistance. For this reason, rotational force of the rollers could not resist frictional resistance of the media to provide slippage on the rollers. Thus crumpling, jamming the media and occasionally resulting in damage thereto, how much more the media with rugged surface do. This will prevent the apparatus from repeating the same operation.

SUMMARY OF THE INVENTION

It is an object of the present invention to provide an apparatus which is capable of dispensing of media in the form of a sheet or web, lamina or the like so as to separate and feed the latter to the next station.

Another object of the invention is to provide a sheet-like medium dispensing apparatus which enables the media to reduce frictional resistance therebetween.

A further object of the invention is to provide a web or lamina-like medium manipulating and dispensing apparatus which fully eliminates defects or disadvantages such as a slip or slippage of the rollers.

Still another object of the invention to provide a web or lamina-like medium manipulating apparatus which is capable of ensuring prevention of jamming or clogging of the media to positively feed, one by one, the media downstream of the roller(s).

These and other objects of the invention are accomplished by the combination and function of the rollers disposed upstream and downstream of a stacker table which is provided with a recess formed therein.

BRIEF DESCRIPTION OF THE DRAWINGS

Further objects and advantages of the invention will become apparent from the following descriptions taken in conjunction with the attached drawings in which.

DETAILED DESCRIPTION OF PREFERRED EMBODIMENTS

Figure 1:
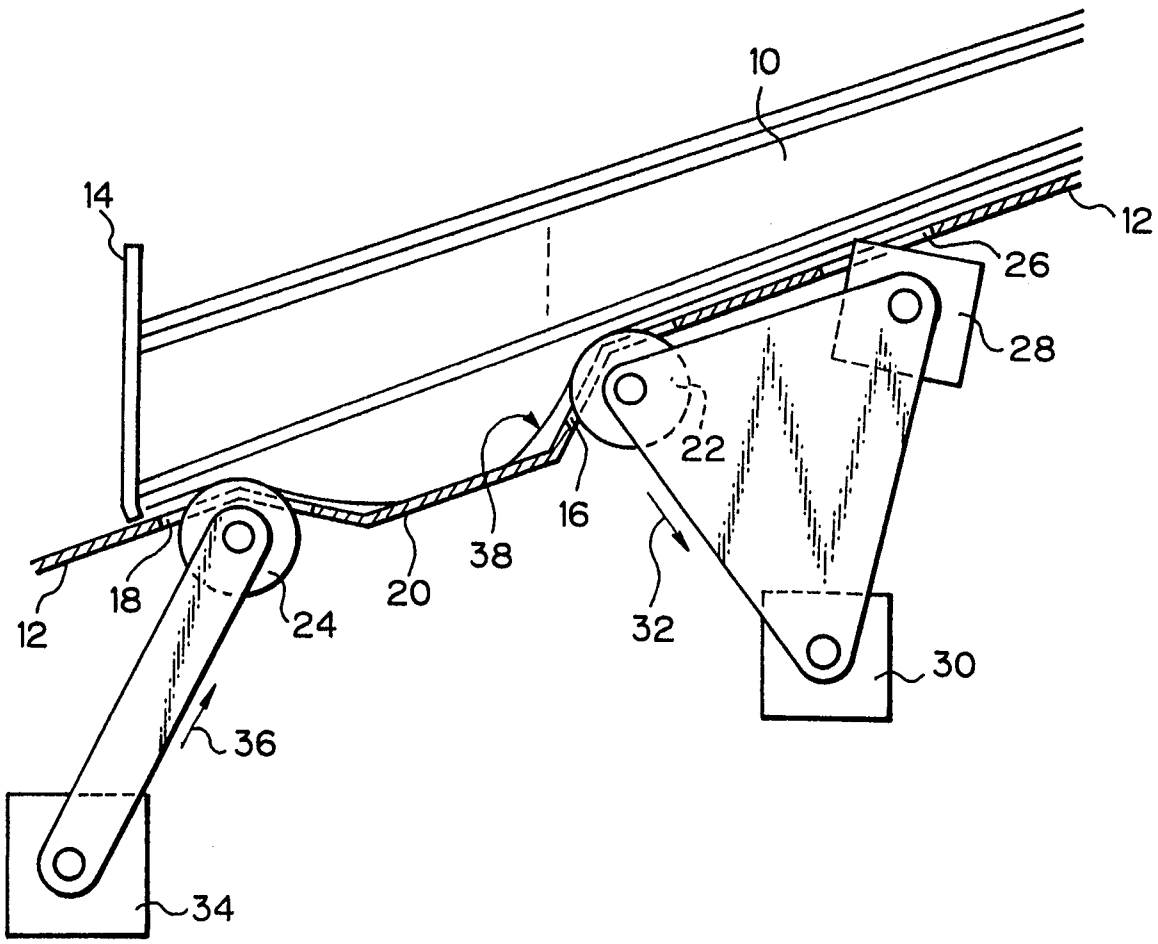
FIG. 1 is a schematic sectional view of a paper sheet material handling device according to a first embodiment of the invention.

FIG. 1 shows a first embodiment of the present invention, in which, a stack of media 10 are stacked on a stacker table 12 with the downstream side (left side in the drawing) being inclined downward. The front or forward edge of the media 10 is retained by a stopper 14.

A pair of openings 16 and 18 are formed in the stacker table 12 to extend along the entire width of the table 12 preferably. A recess 20 is formed in the upper surface of the table 12 and between the grooves 16 and 18. In respective openings 16 and 18, there are provided rotatable friction rollers 22 and 24 (a dispenser roller 22 and a separator roller 24) respectively portions of which project slightly upward from the upper surface of the stacker table 12. The friction rollers 22 and 24 are formed to have surfaces having a high frictional coefficient by being provided with an outer surface made of rubber or the like. The depth of the recess 20 is nearly equal to the diameter of the rollers 22 and 24. In the upstream side (the right side in FIG. 1) of the opening 16, another opening 26 is provided in the stacker table 12. A roller 28 having a generally square shaped cross-section is rotatably mounted in the groove 26. The roller 28 is disposed such that one of the corner portions of the roller 28 projects upward from the upper surface of the stacker table 12 when the roller 28 rotates, whereby when the roller 28 rotates the corner portions of the roller 28 contact sequentially with the media 10 supported on the stacker table 12 thereby vibrating the media 10 in a vertical direction. The roller 28 is preferably formed of a resin or the like having a relatively low frictional coefficient. The roller 28 need not necessarily be formed to have a square cross-section, and may be in the form of a triangle, a pentagon, a hexagon, or any suitable shape having a suitable number of cornered portions on the outer circumference. Thus, the roller 28 is referred to as a square rotator. The friction roller 22 and the square rotator 28 are rotated in synchronized relationship in the direction of the arrow 32 by a motor 30 mounted on a frame of the device and through motion transmitting means such as a belt known per se.

Similarly, the friction roller 24 is driven by another motor 34 which is also mounted on the frame and through a motion transmitting means such as a belt known per se.

In the embodiment, when it is desired to deliver the lowermost medium 38 of the media 10, the motor 30 is actuated with the motor 34 not being actuated. Then, the square rotator 28 is rotated by the motor 30 thereby imparting vibrations acting in a vertical direction to the media 10. The frequency of the vibrations is suitably adjusted to correspond to the amount or weight of the media 10 on the stacker table 12 and the surface condition of the paper sheets constituting the media 10. By increasing the rotational speed of the motor 30, it is possible to improve separating characteristics, but it will be noted that the rotational speed of the motor 30 should be determined with consideration to the size and shape of the square rotator 28 and the surface condition of the stacked sheets. Owing to the vibrations of the square rotator 28 there is formed a slight clearance between respective paper sheets in the media 10 being mounted on the stacker table 12.

The friction roller 22 is also rotated when the square rotator 28 is rotated. But the friction roller 24 is not rotated in this condition, thus the forward end (the left end in FIG. 1) of the lowermost medium 38 is maintained at a standstill condition by the friction roller 24.

By rotation of the friction roller 22 in contact with the lowermost medium 38, the latter is fed in such a manner that its mid-portion is forwardly moved to thus treat the medium 38. Consequently, the medium 38 is moved and enters into the recess 20 in the stacker table 12, as shown.

When the lowermost medium 38 is moved forward by the friction roller 22 such that the sheet medium 38 contacts with nearly the entire surface of the recess 20 in the stacker table 12, the motor 34 is actuated. The friction roller 24 rotates and the lowermost medium 38 of the media 10 now separated from the remaining stack of sheets is separated from the media 10 and is delivered downstream through a gap between the upper surface of the stacker table 12 and the lower edge of the stopper 14.

Figure 3:
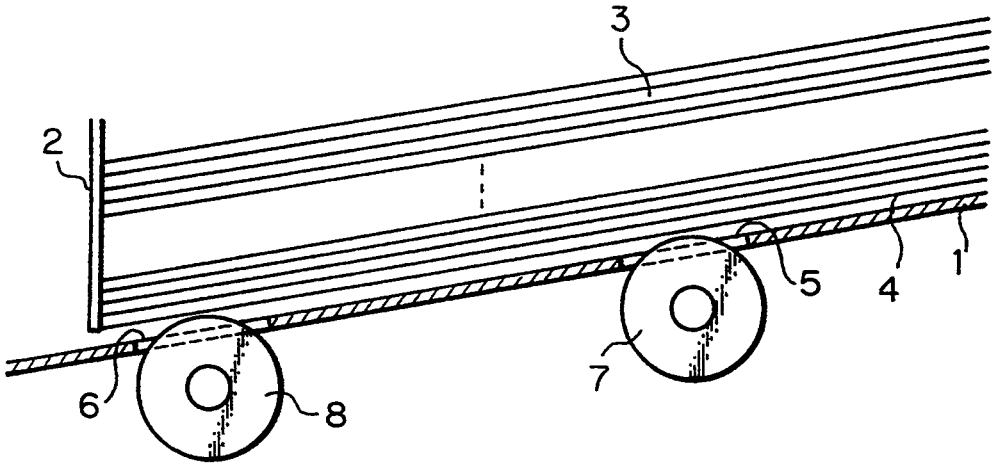
Fig. 3 PRIOR ART
FIG. 3 is a schematic sectional view of a prior art paper sheet material handling device.

According to the embodiment, the mutually contacting area between the lowermost medium 38 and the remaining stack of sheets in the neighborhood of the friction roller 24 is reduced to a minimum. As compared with the prior art device shown in FIG. 3, in which the lowermost medium contacts along the entire surface of an adjacent sheet, the sheet medium 38 according to the present invention can be easily delivered from the media 10 with only a small contacting resistance, thereby solving the problem of slippage and the like.

Figure 2:
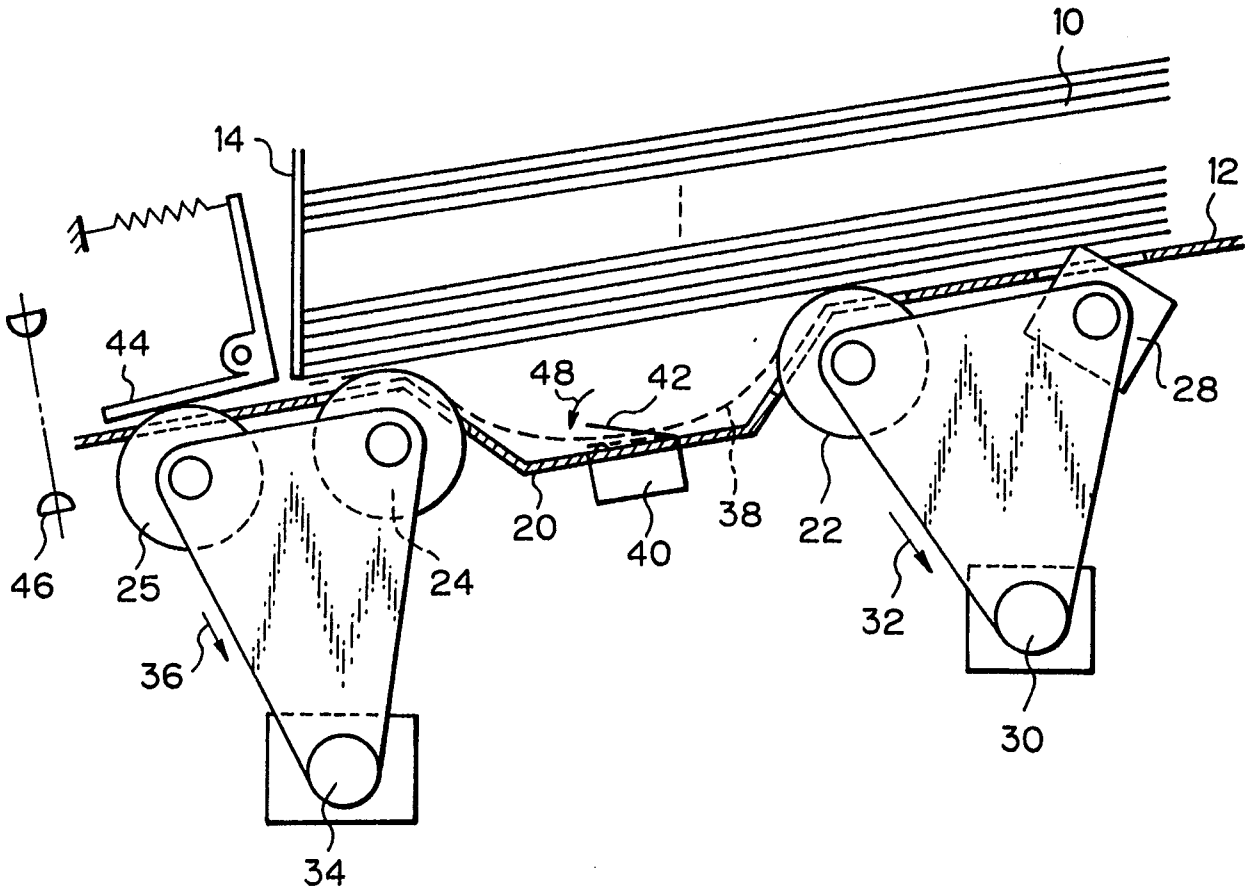
FIG. 2 is a schematic sectional view of a paper sheet material handling device according to a second embodiment of the invention.

FIG. 2 shows another embodiment of the present invention. According to the embodiment of FIG. 1, in moving a portion of the lowermost medium 38 into the recess 20 of the stacker table 12, if the amount of the movement of the lowermost medium 38 into the recess 20 is not sufficient, the friction roller 24 may slip and the amount of the delivery of the sheet medium 38 may become insufficient. The device of FIG. 2 aims to solve this problem.

Reference is now made to FIG. 2, which is generally similar to FIG. 1 with corresponding parts being denoted by the same reference numerals. As shown in FIG. 2, there is provided detection means such as a micro-switch 40 in the recess 20 in the stacker table 12 so as to adjust automatically the timing of actuation of the friction roller 24. A lever 42 of the micro-switch 40 projects upward from the upper surface of the recess 20 in the stacker table 12. Further, for delivering the paper sheet material reliably one sheet at a time, there is provided another friction roller 25 on the downstream of the friction roller 24. The friction rollers 24 and 25 are driven synchronously by a motor 34. A generally L-shaped separating member 44 is provided upward of the friction roller 25 and is biased toward the friction roller 25 by a means such as spring. A sensor 46 is provided on the downstream side of the friction roller 25 to detect the presence of a paper sheet material.

In delivering the lowermost medium 38 of the media 10 which is stacked on the stacker table 12 according to the embodiment of FIG. 2, the motor 30 is actuated firstly with the motor 34 being maintained at a stopper position. The square rotator 28 is rotated by the motor 30 and the media 10 on the stacker table 12 is vibrated in a vertical direction. The frequency of the vibrations or the speed of the motor 30 is determined suitably in considering the amount or the weight of the paper sheet material stacked on the stacker table 12, the surface condition of the paper sheet material and the like. According to the vibrations afforded by the square rotator 28, some clearance may be formed between the paper sheet materials consisting the media 10 on the stacker table 12.

In synchronizing with the rotation of the square rotator 28, the friction roller 22 rotates in a counter clockwise direction as shown in the drawing. Preferably, a one way clutch (not shown in the drawing) is provided to permit free rotation of the roller 22 in the same counter clockwise direction. At this time, the rollers 24 and 25 are maintained in a stopper condition since the motor 34 is not actuated, thus, the forward edge of the lowermost medium 38 of the media 10 is maintained at a standstill by the friction roller 24.

By rotation of the friction roller 22, the intermediate portion of the lowermost medium 38 contacting with the roller 22 is displaced forward, thus being separated from the remaining sheet of the media 10. Thus, a portion of the sheet medium 38 is delivered into the recess 20 in the stacker table 12 as shown in the drawing.

When a portion of the sheet medium 38 is delivered into the recess 20 in the stacker table 12 as shown in the drawing, the lever 42 is pushed by the sheet medium 38 in the direction of the arrow 48 as shown in the drawing, and actuates the micro-switch 40.

When the micro-switch 40 is made to ON, the motor 30 is stoppered and the another motor 34 is actuated to rotate the friction rollers 24 and 25 in the direction of the arrow 36. The paper sheet medium 38 now separated from the media 10 is displaced downstream through a space between the lower end of the stopper 14 and the stacker table 12. When the sheet medium 38 of curved condition is displaced downstream by the friction rollers 24 and 25, the lever 42 moves in the direction opposite to the arrow 48 which puts the microswitch 40 into an OFF position.

When the micro-switch 40 is positioned to be OFF, the motor 34 stops rotating and the motor 30 starts rotating again. The friction roller 22 acts once more as a separating roller to introduce a portion of the lowermost medium 38 of the media into the recess 20 in the stacker table 12. Then, the micro-switch 40 is actuated to stops the actuation of the friction roller 22 and to start the delivery rollers 24 and 25, thereby the paper sheet medium 38 is displaced downstream.

Such an operation is repeated until the light directed into the sensor 46 is intercepted by the front end of the paper sheet medium 38 being delivered. When the light entering the sensor 46 is intercepted, the motor 34 is rotated whereby the friction rollers 24 and 25 are caused to rotate to fully displace the sheet medium 38 to downstream.

When the paper sheet medium 38 has passed through the sensor 46 completely, the device returns to its initial state, and the operation is repeated.

In the embodiment, the separating plate 44 acts such that when two or more sheets are delivered together, the plate 44 intercepts the delivery of the upper sheet and stoppers it at that position and when the sheet of lower side is fully delivered the delivery of the upper sheet is permitted. Thus, sheets are reliably delivered one at a time. Incidentally, the micro-switch 40 is utilized as a detection means, however, the invention is not limited to the embodiment and, any suitable detecting means such as a combination of an intercepting plate projecting on the recess 20 of the stacker table 12 and a photo-interrupter acting in response to the intercepting plate, and the like.

In the embodiment of FIG. 2, similar to the embodiment of FIG. 1, the friction roller 24 acting to separate the paper sheet material enables a substantial reduction in an area of contact between paper sheet materials. Particularly, as shown in FIG. 2, the sheet medium 38 is flexed downward as compared with the prior art shown in FIG. 3, thus, resistance caused by mutual contact is substantially reduced and the sheet medium 38 can easily be delivered, which solves the problem of the slippage of friction rollers. Further, the embodiment of FIG. 2 enables the rotation of the paper sheet material delivering rollers to be stoppered automatically in response to the amount of flexure of the paper sheet material into the recess 20 in the stacker table 12.

As described heretofore, according to the invention, it is possible to effect separation of the paper sheet material and to prevent jamming of the paper sheet material reliably, and to supply reliably a paper sheet material one sheet at a times to the downstream.

What is claimed is:

1. A sheet medium dispensing apparatus for disposing of, one by one, a stack of media in the form of a lamina stacked on a stack table and for feeding said media downstream thereof, comprising a stacker table for stacking a stack of said media thereon and having a recess formed in said table;

a dispenser roller disposed upstream of said recess and upwardly and slightly exposed out of the top of said stacker table;

a square rotator of polygonal cross section so located upstream of said dispenser roller as to have a corner of said rotator exposed out of the top of said stacker table;

a motor for driving said dispenser roller and said square rotator synchronously therewith;

a separator roller disposed downwardly of said recess and slightly exposed out of the top of said stacker table;

a further motor for driving said separator roller; and sensor means within said recess for sensing to what extent said medium is curved to control timing of rotating operation of said motor for driving said dispenser roller 22 and said square rotator 28 and said motor for driving said separator roller 24 whereby the lowermost medium out of said media is introduced by said dispenser roller to said recess and is then fed from said media downwardly of said table.

2. A sheet medium dispensing apparatus as set forth in claim 1 wherein said apparatus includes delivery rollers and sensor means provided downwardly of the stack of media to control timing of rotation of said delivery rollers.

* * * * *